US009383674B2

(12) United States Patent
Iwasaki

(10) Patent No.: US 9,383,674 B2
(45) Date of Patent: Jul. 5, 2016

(54) CONDUCTING BRUSH AND IMAGE FORMING DEVICE

(71) Applicant: FUJI XEROX CO., LTD., Tokyo (JP)

(72) Inventor: Jin Iwasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/714,542

(22) Filed: May 18, 2015

(65) Prior Publication Data

US 2016/0139530 A1 May 19, 2016

(30) Foreign Application Priority Data

Nov. 14, 2014 (JP) ..... 2014-231742

(51) Int. Cl.
*G03G 15/02* (2006.01)

(52) U.S. Cl.
CPC ..... *G03G 15/0216* (2013.01); *G03G 15/0225* (2013.01); *G03G 15/0233* (2013.01)

(58) Field of Classification Search
CPC ..... G03G 15/0216; G03G 15/0225; G03G 15/0233; G03G 21/0035; G03G 2215/021
USPC ..... 399/176, 175, 100; 361/221
See application file for complete search history.

(56) References Cited

U.S. PATENT DOCUMENTS

| | | | | |
|---|---|---|---|---|
| 5,508,879 | A * | 4/1996 | Kitamura | G03G 21/0035 361/221 |
| 7,471,918 | B2 | 12/2008 | Shishido et al. | |
| 2009/0214276 | A1 * | 8/2009 | Shibuya | G03G 15/161 399/354 |
| 2012/0003022 | A1 * | 1/2012 | Pickering | G03G 21/0035 399/354 |
| 2013/0243485 | A1 * | 9/2013 | Iwasaki | G03G 15/0233 399/174 |

FOREIGN PATENT DOCUMENTS

| | | | |
|---|---|---|---|
| JP | 08-095393 | A * | 4/1996 |
| JP | 2006-221091 | A | 8/2006 |
| JP | 2007-121884 | A | 5/2007 |
| JP | 2013-195527 | A | 9/2013 |

* cited by examiner

*Primary Examiner* — Sophia S Chen
(74) *Attorney, Agent, or Firm* — Sughrue Mion, PLLC

(57) ABSTRACT

A conducting brush includes a substantially cylindrical insulating film base; and a conducting fiber adhering to an outer peripheral surface of the insulating film base through a conducting adhesive or a conducting adhesive medium. An outer peripheral portion where the conducting fiber adheres and at least a portion of an inner peripheral portion of the insulating film base have electrical continuity through the conducting adhesive or the conducting adhesive medium.

7 Claims, 17 Drawing Sheets

FIG. 13

| | COST | VERTICAL LINE IN HALFTONE (COLOR LINE) |
|---|---|---|
| EXAMPLE 1 WITH CHARGING MEMBER ACCORDING TO ANY OF FIRST TO FOURTH EXEMPLARY EMBODIMENTS AND INSIDE POWER SUPPLY MEMBER | ○ | ○ |
| COMPARATIVE EXAMPLE 1 | ○ | × |
| COMPARATIVE EXAMPLE 2 | × | ○ |

FIG. 20

| | COST | VERTICAL LINE IN HALFTONE (COLOR LINE) |
|---|---|---|
| EXAMPLE 2 WITH CONDUCTING BRUSH ACCORDING TO ANY OF FIRST TO FOURTH EXEMPLARY EMBODIMENTS AND INSIDE ENERGIZING MEMBER | ○ | ○ |
| COMPARATIVE EXAMPLE 3 | ○ | × |
| COMPARATIVE EXAMPLE 4 | × | ○ |

CONDUCTING BRUSH AND IMAGE FORMING DEVICE

CROSS-REFERENCE TO RELATED APPLICATIONS

This application is based on and claims priority under 35 USC 119 from Japanese Patent Application No. 2014-231742 filed Nov. 14, 2014.

BACKGROUND

The present invention relates to a conducting brush and an image forming device.

SUMMARY

According to an aspect of the invention, there is provided a conducting brush includes a substantially cylindrical insulating film base; and a conducting fiber adhering to an outer peripheral surface of the insulating film base through a conducting adhesive or a conducting adhesive medium. An outer peripheral portion where the conducting fiber adheres and at least a portion of an inner peripheral portion of the insulating film base have electrical continuity through the conducting adhesive or the conducting adhesive medium.

BRIEF DESCRIPTION OF THE DRAWINGS

Exemplary embodiments of the present invention will be described in detail based on the following figures, wherein:

FIG. 13 is a table showing the results of the example and the comparative examples;

FIG. 20 is a table showing the results of the example and the comparative examples.

DETAILED DESCRIPTION

Exemplary embodiments of the invention are described below with reference to the drawings.

First Exemplary Embodiment

Figure 1:
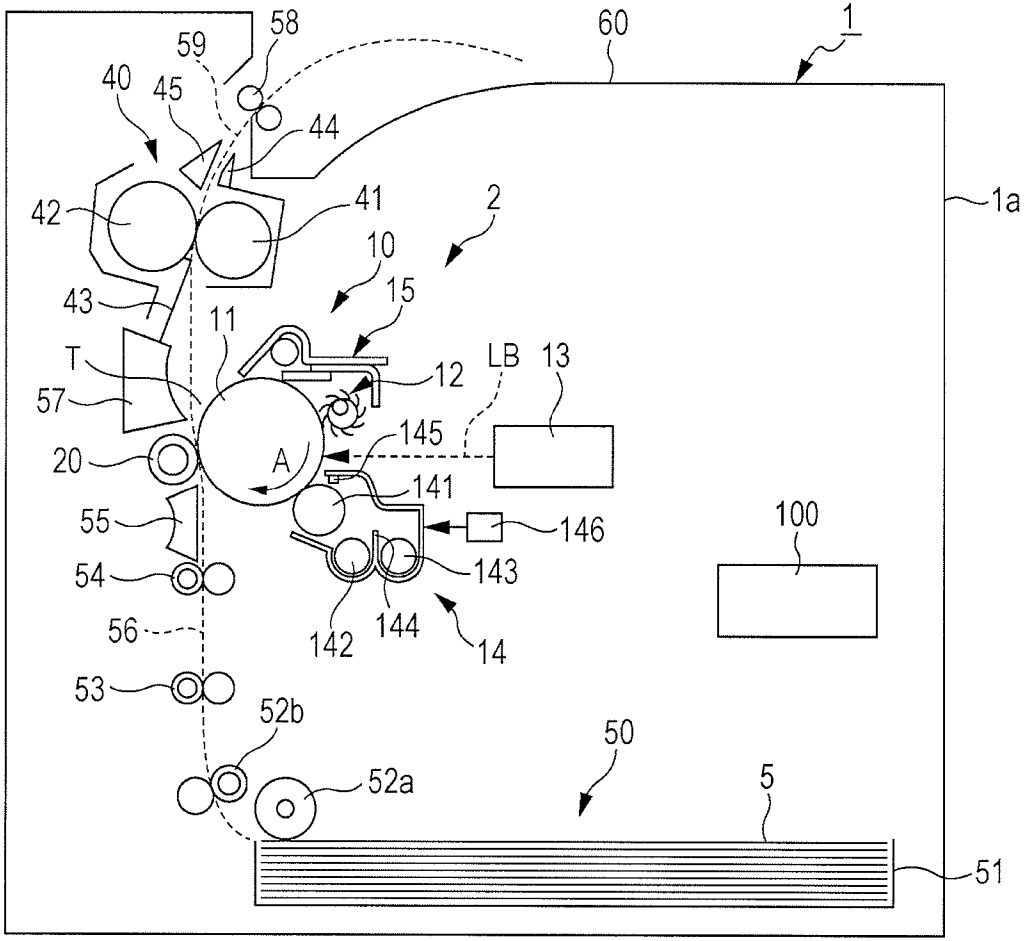
FIG. 1 is a configuration diagram showing an image forming device to which a charging device according to a first exemplary embodiment of the invention is applied.
Figure 2:
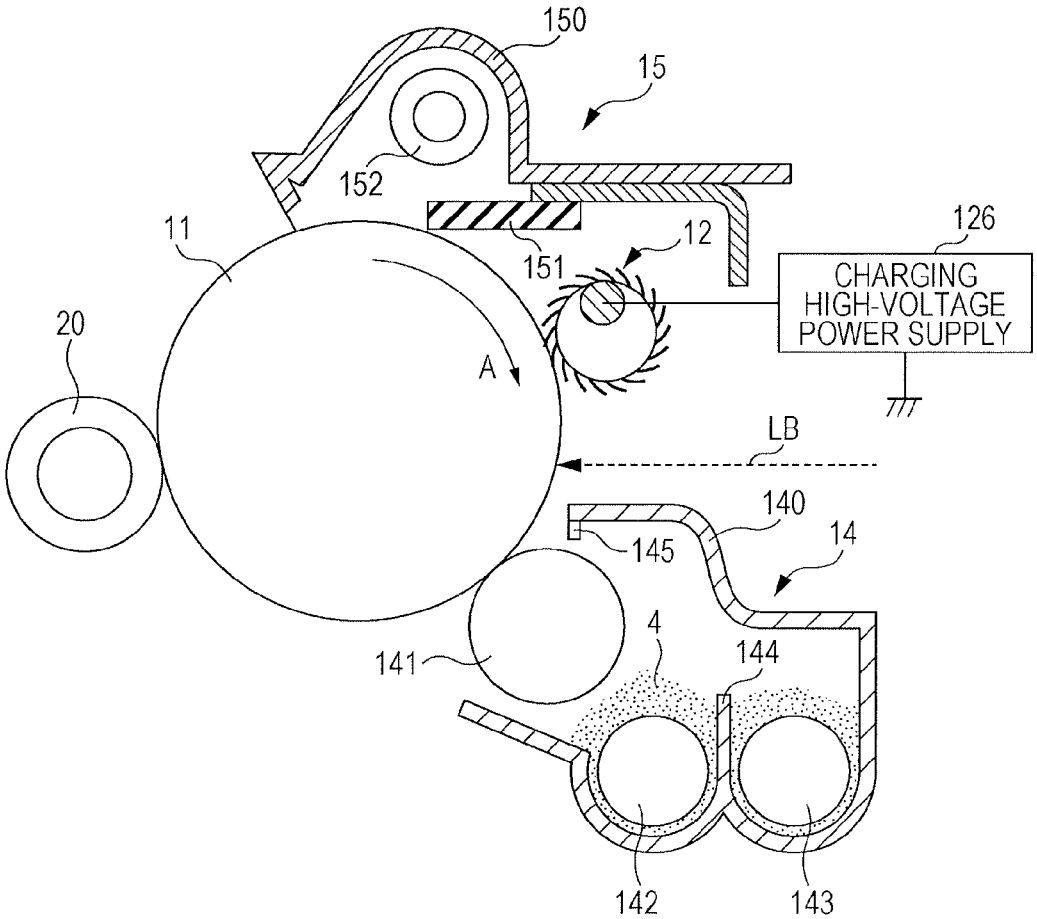
FIG. 2 is a configuration diagram showing an image forming unit of the image forming device according to the first exemplary embodiment of the invention.

FIGS. 1 and 2 are configuration diagrams each showing an image forming device to which a conducting brush and a charging device according to a first exemplary embodiment of the invention are applied. FIG. 1 illustrates the overview of the image forming device, and FIG. 2 illustrates a major part (an image generating device etc.) of the image forming device in an enlarged manner.

General Configuration of Image Forming Device

An image forming device 1 according to the first exemplary embodiment is formed as, for example, a monochrome printer. The image forming device 1 includes an image forming unit 2 as an example of an image forming section that forms an image on a recording medium in accordance with image data.

The image forming unit 2 includes an image generating device 10 that forms a toner image developed with a toner configuring a developer; a transfer device 20 that transfers the toner image formed by the image generating device 10 to a recording sheet 5 as an example of the recording medium; a paper feed device 50 that houses and transports a predetermined recording sheet 5 to be fed to a transfer position T of the transfer device 20; and a fixing device 40 that fixes the toner image on the recording sheet 5 transferred by the transfer device 20. In FIG. 1, reference sign 1*a* denotes an image forming device body formed of a support structure member, an outer covering part, and other member.

The image generating device 10 is configured of a single image generating device that is dedicated to form a toner image of black (K) color. The image generating device 10 is arranged at a predetermined position near one of side walls (in the illustrated example, left side) in the inner space of the image forming device body 1*a*.

As shown in FIG. 1, the image generating device 10 includes a photoconductor drum 11 as an example of a rotating image holding body. The following respective devices are arranged around the photoconductor drum 11. The major devices include a charging device 12 that electrically charges a peripheral surface (an image holding surface), on which an image may be formed, of the photoconductor drum 11 to a predetermined potential; an exposure device 13 as an example of an electrostatic latent image forming unit that irradiates the electrically charged peripheral surface of the photoconductor drum 11 with light LB in accordance with image information (signal) and hence forms an electrostatic latent image with a potential difference; a developing device 14 as an example of a developing unit that develops the electrostatic latent image with the toner of the developer of black color (K) into a toner image; and a drum cleaning device 15 that removes an adhering substance such as the toner remaining on and adhering to the image holding surface of the photoconductor drum 11 after the transfer and hence cleans up the photoconductor drum 11.

The photoconductor drum 11 has the image holding surface formed on the peripheral surface of a cylindrical or columnar base which is grounded, the image holding surface having a photoconductive layer (a photosensitive layer) made of a photosensitive material. The photoconductor drum 11 is supported rotatably in a direction indicated by arrow A when receiving a power transmitted from a rotationally driving device (not shown).

The charging device 12 is configured of a contact-type charging device arranged in contact with the photoconductor drum 11. To the charging device 12, a charging voltage is applied from a charging high-voltage power supply. If the developing device 14 performs reversal development, a voltage or a current with the same polarity as the charging polarity of the toner supplied from the developing device 14 is supplied as the charging voltage. The configuration of the charging device 12 is described later.

The exposure device 13 irradiates the peripheral surface of the photoconductor drum 11 after the photoconductor drum 11 is electrically charged, with light (indicated by a broken line with an arrowhead) LB configured in accordance with information of an image input to the image forming device 1 and hence forms an electrostatic latent image. When an electrostatic latent image is formed, information of an image (a signal) that is input to the image forming device 1 by a proper method is transmitted to the exposure device 13.

As shown in FIG. 2, the developing device 14 includes, in a housing 140 having an opening and a housing chamber for a developer 4, a development roller 141 that holds the developer 4 and transports the developer 4 to a development region facing the photoconductor drum 11; stir and transport members 142 and 143 such as screw augers (not shown) that transport the developer 4 while stirring the developer 4 to cause the developer 4 to pass through the development roller 141; a partition wall 144 that divides a first housing chamber housing the one stir and transport member 142 and a second housing chamber housing the other stir and transport member 143; and a layer-thickness limit member 145 that limits the amount (layer thickness) of the developer held on the development roller 141. A developing voltage is supplied to the developing device 14, in particular, a part between the development roller 141 and the photoconductor drum 11, from a power supply device (not shown). Also, the development roller 141 and the stir and transport members 142 and 143 rotate in a predetermined direction when receiving a power transmitted from a rotational driving device (not shown). Further, as the above-described developer 4, a two-component developer containing a nonmagnetic toner and a magnetic carrier is used. In FIG. 1, reference sign 146 schematically illustrates a developer supply device that supplies the developer containing at least the toner to the developing device 14.

The transfer device 20 is a contact-type transfer device including a transfer roller that contacts the peripheral surface of the photoconductor drum 11 and rotates at a transfer position T, and receives a supplied transfer voltage. As the transfer voltage, a direct-current voltage with a polarity reverse to the charging polarity of the toner is supplied from a power supply device (not shown).

As shown in FIG. 2, the drum cleaning device 15 includes a cleaning plate 151 that is arranged in a container-shaped body 150, removes an adhering substance such as a remaining toner, and hence cleans up the photoconductor drum 11; and a transport member 152 such as a screw auger (not shown) that transports the adhering substance collected by the cleaning plate 151 to an external collection container. The cleaning plate 151 uses a plate-shaped member (for example, a blade) made of a material such as rubber.

The fixing device 40 includes a heating rotating body 41 in a roller form or a belt form that is heated by a heating unit so that the surface temperature is held at a predetermined temperature, and a pressing rotating body 42 in a roller form or a belt form that contacts the heating rotating body 41 with a predetermined pressure and rotates. In the fixing device 40, a contact part where the heating rotating body 41 contacts the pressing rotating body 42 serves as a fixing processing part where predetermined fixing processing (heating and pressing) is performed.

The paper feed device 50 is arranged at a position in a lower section of the image forming device body 1*a*. The paper feed device 50 includes a single (or plural) sheet housing body 51 that houses recording sheets 5 of a predetermined type with a predetermined size in a stacked manner; and sending devices 52*a* and 52*b* that send out the recording sheets 5 from the sheet housing body 51 one by one. The sheet housing body 51 is attached so as to be pulled out toward the front side of the image forming device body 1*a* (a side surface that faces a user when the user operates the device).

A paper-feed transport path 56 is arranged between the paper feed device 50 and the transfer device 20. The paper-feed transport path 56 includes plural sheet transport roller pairs 53 and 54 and a transport guide member 55 that transport the recording sheet 5 sent out from the paper feed device 50 to the transfer position T. The sheet transport roller pair 54 arranged at a position immediately before the transfer position T in the paper-feed transport path 56 is configured as, for example, a roller (a registration roller) that adjusts the transport timing of the recording sheet 5.

A transport guide member 57 that transports the recording sheet 5 with a toner image transferred thereon by the transfer device 20 to the fixing device 40 is arranged downstream of the transfer device 20. Also, an inlet guide member 43 that guides the recording sheet 5 to the fixing processing part where the heating rotating body 41 and the pressing rotating body 42 contact is provided at the inlet of the fixing device 40, and outlet guide members 44 and 45 that guide the recording sheet 5 treated with the fixing processing are provided at the outlet of the fixing device 40.

A sheet-output transport path 59 is provided downstream of the fixing device 40. The sheet-output transport path 59 includes a sheet output roller 58 that outputs the recording sheet 5 after the toner image is fixed by the fixing device 40 to a sheet output unit 60 arranged at the top of the image forming device body 1*a*.

In FIG. 1, reference sign 100 denotes a controller that provides centralized control for the operation of the image forming device 1. Although not shown, the controller 100 includes, for example, a central processing unit (CPU), a read only memory (ROM), a random access memory (RAM), a bus connecting these CPU, ROM, etc., and a communication interface.

Basic Operation of Image Forming Device

A basic image forming operation by the image forming device 1 is described below.

Described here is an image forming operation when a monochrome image formed of a toner image of black color (K) by using the image generating device 10.

When the image forming device 1 receives instruction information of a request for an image forming operation (printing), the image generating device 10, the transfer device 20, the fixing device 40, and other device are activated.

Then, in the image generating device 10, first the photoconductor drum 11 rotates in the direction indicated by arrow A, and the charging device 12 electrically charges the surface of the photoconductor drum 11 to a predetermined polarity (in the first exemplary embodiment, minus polarity) and a predetermined potential. Then, the exposure device 13 irradiates the electrically charged surface of the photoconductor drum 11 with the light LB emitted in accordance with an image signal input to the image forming device 1, and hence forms an electrostatic latent image configured of a predetermined potential difference on the surface.

Then, the developing device 14 supplies the toner, which is electrically charged to a predetermined polarity (minus polarity), to electrostatically adhere to the electrostatic latent image formed on the photoconductor drum 11, and hence performs development. With this development, the electrostatic latent image formed on the photoconductor drum 11 is visualized as a toner image developed with the toner.

Then, when the toner image formed on the photoconductor drum 11 of the image generating device 10 is transported to the transfer position T, the transfer device 20 transfers the toner image on the recording sheet 5.

Also, in the image generating device 10 after the transfer is completed, the drum cleaning device 15 removes an adhering substance such as the remaining toner on the surface of the photoconductor drum 11 by scraping the adhering substance, and hence cleans up the surface of the photoconductor drum 11. Accordingly, the image generating device 10 becomes a state available for the next image generating operation.

Meanwhile, the paper feed device 50 sends out the predetermined recording sheet 5 to the paper-feed transport path 56 at a timing corresponding to the image generating operation. In the paper-feed transport path 56, the sheet transport roller pair 54 serving as the registration roller sends out and supplies the recording sheet 5 to the transfer position T at a timing corresponding to the transfer timing.

Then, the recording sheet 5 after the toner image is transferred thereon is transported to the fixing device 40 through the transport guide member 57. The fixing device 40 causes the recording sheet 5 after the transfer to be introduced to and to pass through the fixing processing part between the rotating heating rotating body 41 and pressing rotating body 42 through the inlet guide member 43, so that required fixing processing (heating and pressing) is performed and the unfixed toner image is fixed to the recording sheet 5. Finally, the recording sheet 5 after the fixing is completed is output to, for example, the sheet output unit 60 provided at the top of the image forming device 1 by the sheet output roller 58 through the sheet-output transport path 59.

By the above-described operation, the recording sheet 5 having a monochrome image formed on one side thereof is output.

Configuration of Charging Device

Figure 3:
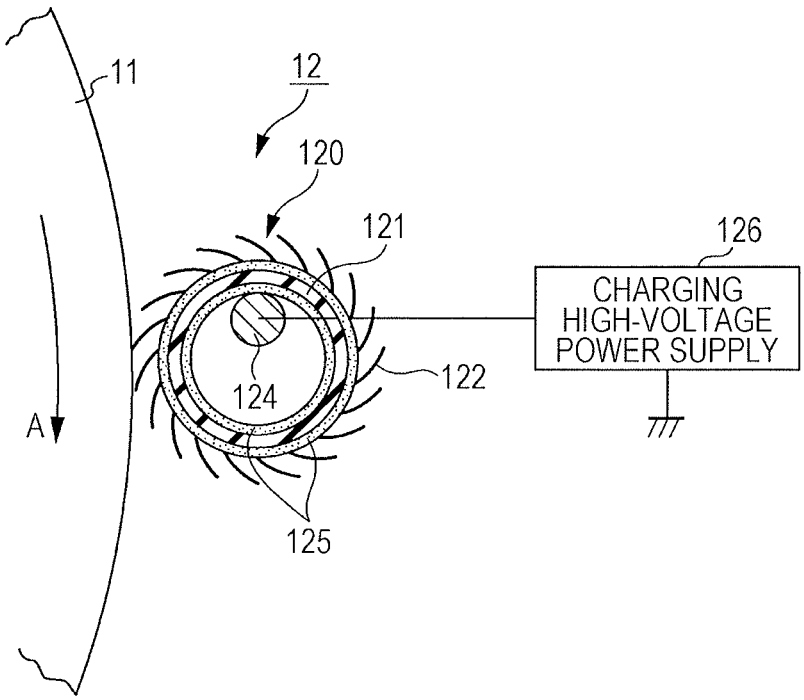
FIG. 3 is an enlarged configuration diagram showing the charging device.

FIG. 3 is a configuration diagram showing the charging device 12 according to the first exemplary embodiment of the invention.

As shown in FIG. 3, the charging device 12 includes a charging member 120 as an example of a conducting brush in which conducting fibers 122 adhere to the outer peripheral surface of a cylindrical or substantially cylindrical insulating film base 121; and a power supply member 124 as an example of a voltage applying unit that is arranged to contact the inner peripheral surface (inner peripheral portion) of the charging member 120 and applies a charging voltage to the conducting fibers 122 of the charging member 120. The inner peripheral surface of the charging member 120 represents the inner peripheral surface of the insulating film base 121, and in addition, if a conducting adhesive 125 (described later) is applied to the inner peripheral surface of the insulating film base 121 or a conducting tape (not shown) is bonded to the inner peripheral surface of the insulating film base 121, the inner peripheral surface of the charging member 120 represents an inner peripheral portion including the conducting adhesive 125 or the conducting tape. For example, the insulating film base 121 is formed so that the free form without an external force acting thereon is a cylindrical shape having a predetermined outer diameter. In this case, the insulating film base 121 does not have to be a perfect circular shape, and may be a substantially cylindrical shape. The insulating film base 121 may directly use a film member made of an insulating material. The material of the insulating film base 121 may be, for example, a synthetic resin, such as, polyethylene terephthalate, polyamide, polyimide, polyamide-imide, polyethylene, polycarbonate, polyurethane, polyvinylidene fluoride, polyethylene naphthalate, polyether ketone, polyether sulfone, polyphenylene sulfide, or a fluorine plastic like any of PFA, ETEF, and CTEF; or a synthetic rubber, such as silicone rubber, ethylene propylene diene rubber, ethylene propylene rubber, butyl rubber, acrylic rubber, urethane rubber, or nitrile rubber. In this exemplary embodiment, a cylindrical film made of polyethylene terephthalate is used as the insulating film base 121.

Of course, the insulating film base 121 may be directly formed of a material, such as the above-described synthetic resin or synthetic rubber, in a cylindrical or substantially cylindrical shape (so-called seamless shape). However, the insulating film base 121 may have a seam as long as the insulating film base 121 is formed finally in a cylindrical or substantially cylindrical shape.

Also, the thickness of the insulating film base 121 is not particularly limited. However, the insulating film base 121 may desirably have flexibility so that the insulating film base 121 is rotatable by rotation of the photoconductor drum 11 as the image holding body (body to be electrically charged). In this exemplary embodiment, a film base used as the insulating film base 121 is made of polyethylene terephthalate formed in a cylindrical shape with an outer diameter in a range from 10 to 12 mm and a relatively small thickness of about 50 μm.

The conducting fibers 122 densely adhere to the outer peripheral surface of the insulating film base 121 by, for example, electrostatic adhesion. The conducting fibers 122 may use, for example, fibers made of a synthetic resin formed such that a conducting material such as carbon black is dispersed in a synthetic resin such as nylon, rayon, or polyester, the obtained material is spun, and hence the volume resistivity is adjusted. In this exemplary embodiment, the conducting fibers 122 employ fibers made of nylon in which carbon black is dispersed. For example, the conducting fibers 122 have a volume resistivity in a range from $10^3$ to $10^{10}$ Ω·cm. If the volume resistivity is $10^2$ Ω·cm or lower, spark discharge may likely occur. If the volume resistivity is $10^{11}$ Ω·cm or higher, a charging failure in a dot form may likely occur. In this exemplary embodiment, the conducting fibers 122 with a volume resistivity in a range from about $10^6$ to about $10^7$ Ω·cm are used.

Also, the conducting fibers 122 have a length in a range from about 0.5 to about 2.0 mm. The conducting fibers 122 have a thickness in a range from about 0.5 to about 10 d (deniers). In this exemplary embodiment, the conducting fibers 122 with a thickness 2 d (deniers) are used. Also, the conducting fibers 122 have an adhesion density of, for example, 100,000 to 200,000/inch$^2$, however, it is not limited thereto.

Figure 4:
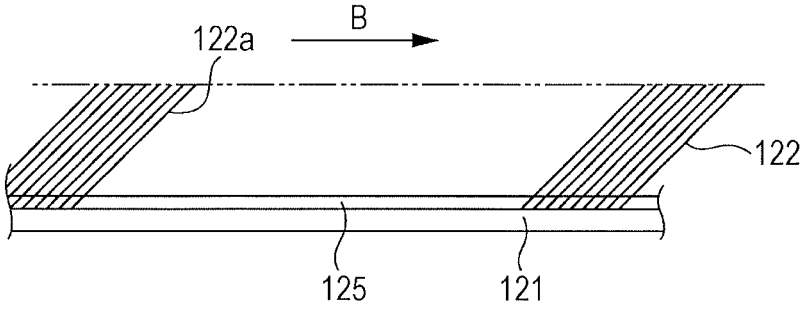
FIG. 4 is an explanatory illustration showing an adhesion state of conducting fibers.

As shown in FIG. 4, the conducting fibers 122 adhere by electrostatic adhesion with a substantially uniform density in a state in which the conducting adhesive 125 of acryl-base, urethane-base, epoxy-base, or silicone-base is applied on the outer periphery of the insulating film base 121.

The conducting adhesive 125 may use any kind of acryl-base, urethane-base, epoxy-base, or silicone-base as described above. The conducting adhesive 125 is formed by blending and dispersing a filler with conductivity in a synthetic resin with hardenability, such as acrylic resin, urethane resin, epoxy resin, or silicone resin. The filler with conductivity may be, for example, fine particles of silver (Ag), a conducting structure of carbon (graphite etc.), or nanocarbon. Also, the conducting adhesive 125 may be used by properly adjusting its viscosity by using a solvent if required with regard to application easiness when the conducting adhesive 125 is applied to the outer peripheral surface of the insulating film base 121.

The conducting fibers 122 may be arranged in the outer peripheral surface of the insulating film base 121 in a substantially perpendicular state. However, the conducting fibers 122 may be desirably arranged in a state in which tip ends 122*a* of the conducting fibers 122 are tilted toward the downstream side along a rotation direction B of the charging member 120 or in a state in which the tip ends 122*a* are laid substantially in parallel to the direction along the rotation direction B. If the conducting fibers 122 are arranged on the outer peripheral surface of the insulating film base 121 in the substantially perpendicular state, or in the state in which the tip ends 122*a* of the conducting fibers 122 are tilted toward the upstream side along the rotation direction B of the charging member 120, the conducting fibers 122 contact the surface of the photoconductor drum 11 and bent, and then when the conducting fibers 122 are separated from the surface of the photoconductor drum 11, the tip ends 122*a* of the conducting fibers 122 slide on the surface of the photoconductor drum 11. Hence, the charging potential of the photoconductor drum 11 may be uneven.

The conducting fibers 122 may be directly arranged in the state in which the tip ends 122*a* are tilted toward the downstream side along the rotation direction B of the charging member 120. However, after the conducting fibers 122 are arranged substantially perpendicularly in the outer peripheral surface of the insulating film base 121, a mechanical force and/or heat may be applied, so that the tip ends 122*a* are tilted toward the upstream side along the rotation direction B of the charging member 120.

Alternatively, as long as the unevenness occurring in the charging potential of the photoconductor drum 11 is negligible, the conducting fibers 122 may be arranged substantially perpendicularly in the outer peripheral surface of the insulating film base 121, or in a manner that the tip ends 122*a* of the conducting fibers 122 are tilted toward the downstream side along the rotation direction B of the charging member.

In the charging member 120 thus configured, for example, a power supply member (not shown) arranged outside the charging member 120 is brought into contact with the conducting fibers 122 adhering to the outer peripheral surface of the insulating film base 121, and hence the conducting fibers 122 are supplied with the charging voltage.

Figure 5:
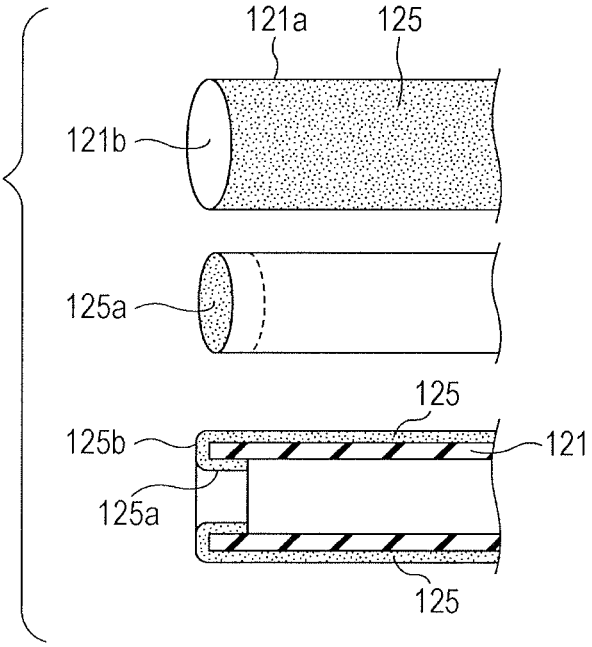
FIG. 5 is a configuration diagram showing a manufacturing method of a charging member.

In this exemplary embodiment, as shown in FIG. 5, the conducting adhesive 125 is applied to an outer peripheral portion 121*a* of the insulating film base 121 of the charging member 120 to cause the conducting fibers 122 to adhere to the outer peripheral portion 121*a*. Also, the conducting adhesive 125 is applied to extend from an end portion of the outer peripheral surface in the longitudinal direction of the insulating film base 121 to at least a portion of the inner peripheral surface of the insulating film base 121, so that the outer peripheral portion and at least a portion of the inner peripheral portion of the insulating film base 121 have electrical continuity through the conducting adhesive 125. On an inner peripheral portion 121*b* of the insulating film base 121, for example, a conducting adhesive 125*a* is applied in a substantially cylindrical shape to extend from an end portion of the outer peripheral surface in the longitudinal direction of the insulating film base 121 by a predetermined length. In FIG. 5, reference sign 125*b* denotes a conducting adhesive exposed at the end portion of the insulating film base 121. The outer peripheral portion 121*a* and a portion of the inner peripheral portion 121*b* of the insulating film base 121 have electrical continuity (are electrically connected) through the conducting adhesives 125, 125*a*, and 125*b*. Alternatively, the outer peripheral portion 121*a* and a portion of the inner peripheral portion 121*b* of the insulating film base 121 may have electrical continuity through a conducting tape (not shown).

Figure 6:
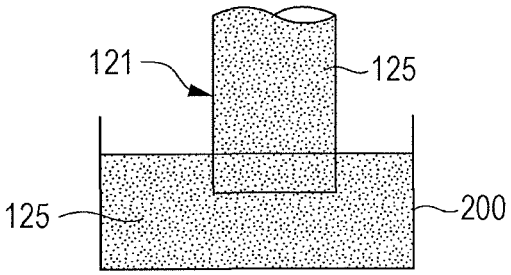
FIG. 6 is a schematic diagram showing another manufacturing method of a charging device.

To apply the conducting adhesive 125*a* to the inner peripheral portion (inner peripheral surface) 121*b* of the insulating film base 121, as shown in FIG. 6, the insulating film base 121 having the conducting adhesive 125 applied on the entire surface of the outer peripheral portion (outer peripheral surface) 121*a* is held substantially perpendicularly along the vertical direction in a state in which the conducting adhesive 125 is dried or not dried, and the conducting adhesive 125 is applied by so-called dipping in which an end portion of the insulating film base 121 is dipped in a container 200 housing the conducting adhesive 125 in a liquid state by a predetermined depth. Regarding the order of applying the conducting adhesive 125, the conducting adhesive 125 may be applied first to the inner peripheral surface of the insulating film base 121. Alternatively, the conducting adhesive 125 may be applied to the entire inner peripheral surface of the insulating film base 121.

Figure 7:
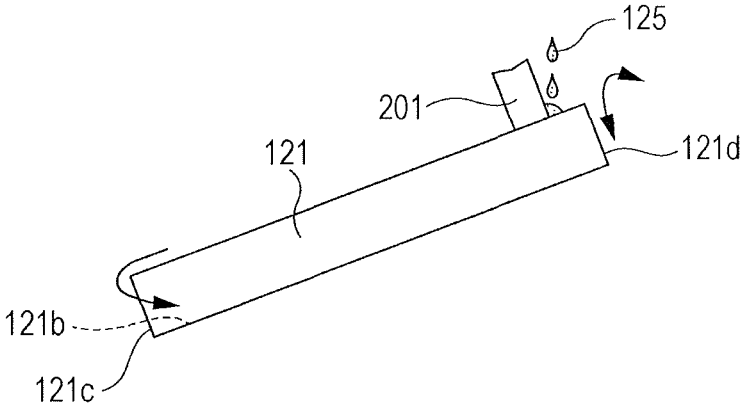
FIG. 7 is a schematic diagram showing still another manufacturing method of a charging device.

Still alternatively, to apply the conducting adhesive 125 to the inner peripheral portion 121*b* of the insulating film base 121, as shown in FIG. 7, the cylindrical insulating film base 121 is held such that a first end 121*c* is tilted to the lower side and a second end 121*d* is tilted to the upper side, the conducting adhesive 125 is applied to the entire surface of the outer peripheral portion 121*a* of the insulating film base 121 by using an applying member 201, such as a blade or a brush, and the conducting adhesive 125 is applied to extend from the first end 121*c* along the longitudinal direction of the insulating film base 121 to the inner peripheral portion 121*b*. Hence, a layer of the conducting adhesive 125 is formed on the outer peripheral portion 121*a* and at an end portion of the inner peripheral portion 121*b* of the insulating film base 121. At this time, the conducting adhesive 125 is applied to the insulating film base 121 while the insulating film base 121 rotates in a proper desirable direction.

As described above, since the conducting adhesive 125 is applied to extend from the end portion of the outer peripheral surface in the longitudinal direction of the insulating film base 121 to at least a portion of the inner peripheral surface of the insulating film base 121, the outer peripheral portion 121*a* and at least a portion of the inner peripheral portion 121*b* of the insulating film base 121 have electrical continuity through the conducting adhesive 125.

In the insulating film base 121 of the charging member 120, the power supply member 124 configuring a portion of the voltage applying unit that applies the charging voltage to the conducting fiber 122 through the conducting adhesive 125 is arranged to contact the insulating film base 121 by the entire length along the longitudinal direction of the charging member 120. The power supply member 124 may have any shape as long as the power supply member 124 may apply the charging voltage to the charging member 120. For example, the power supply member 124 may have any shape of a plate shape, a rod shape, a loop shape, a brush shape, and a foam shape. Also, the material of the power supply member 124 may be any material as long as the material has a lower volume resistivity than that of the conducting fiber 122 of the charging member 120. For example, the power supply member 124 may be formed of metal; or a synthetic resin, a synthetic rubber, or a synthetic foam having conductivity. In this exemplary embodiment, the columnar power supply member 124 with a smaller diameter than the inner diameter of the insulating film base 121 is used.

A predetermined charging voltage with the same polarity (minus polarity) as the charging polarity of the toner is applied to the power supply member 124 from a charging high-voltage power supply 126 (see FIG. 2) as an example of a voltage applying unit. Alternatively, a direct-current voltage with an alternating-current voltage superimposed may be applied to the power supply member 124.

Operation of Characteristic Part of Image Forming Device

As described above, when the image forming device 1 receives instruction information of a request for an image forming operation (printing), the image generating device 10, the transfer device 20, the fixing device 40, and other device are activated.

Then, in the image generating device 10, first the photoconductor drum 11 rotates in the direction indicated by arrow A, and the charging device 12 electrically charges the surface of the photoconductor drum 11 to a predetermined polarity (in the first exemplary embodiment, minus polarity) and a predetermined potential.

At this time, as shown in FIG. 3, in the charging device 12, the power supply member 124 contacts the conducting adhesive 125 through the conducting adhesive 125*a* applied to the inner peripheral portion 121*b* at the one end portion along the longitudinal direction of the insulating film base 121 of the charging member 120 and hardened, and the charging voltage is applied by the charging high-voltage power supply 126 through the power supply member 124. Accordingly, the charging voltage is applied to the conducting fibers 122 electrostatically adhering to the surface of the insulating film base 121 through the power supply member 124, the conducting adhesive 125, the conducting adhesive 125*a*, and the conducting adhesive 125*b*. Hence, in the charging device 12, the charging member 120 is rotationally driven by the movement of the surface of the photoconductor drum 11 while the conducting fibers 122 densely adhering to the outer peripheral portion 121*a* of the insulating film base 121 are attracted to the surface of the photoconductor drum 11 by an electrostatic force. At this time, the charging member 120 electrically charges the surface of the photoconductor drum 11 to a predetermined potential by minute discharge occurring at a very small gap formed at the upstream side and the downstream side along the rotation direction of a contact region where the charging member 120 contacts the surface of the photoconductor drum 11.

As described above, in the exemplary embodiment, even if the film base 121 with the conducting fibers 122 adhering does not have conductivity (in case of being insulating), electrical conductivity may be ensured for the conducting fibers 122 from the inner peripheral portion 121*b* located opposite to the outer peripheral portion 121*a* to which the conducting fibers 122 adhere. Consequently, in the charging device 12, the charging voltage may be applied from the power supply member 124 arranged inside the insulating film base 121 to the conducting fibers 122 adhering to the outer peripheral surface of the insulating film base 121. The power supply member 124 may be restricted from being contaminated by the toner or a foreign substance such as an additive. The charging performance of the power supply member 124 may be maintained for a long period. Also, the insulating film base 121 may be used as a film base to which the conducting fibers 122 adhere. As compared with a case in which a conducting film base is used as a film base, an increase in cost may be avoided.

Second Exemplary Embodiment

Figure 8A:
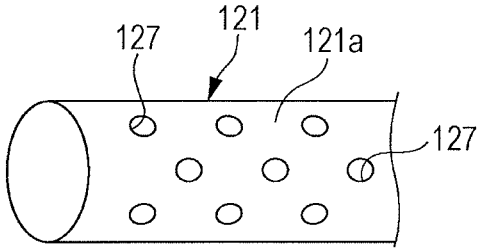
FIGS. 8A to 8C are configuration diagrams each showing a charging device according to a second exemplary embodiment of the invention.
Figure 8B:
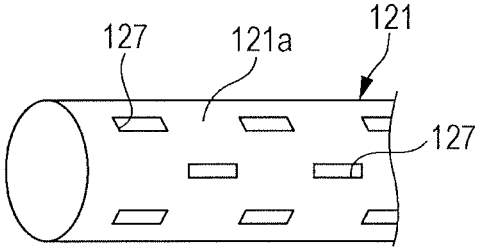
Figure 8C:
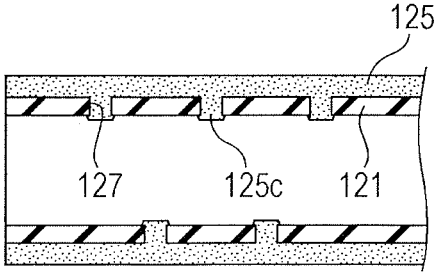

FIGS. 8A to 8C are configuration diagrams each showing a charging device according to a second exemplary embodiment of the invention.

In this second exemplary embodiment, as shown in FIGS. 8A to 8C, the insulating film base 121 has plural holes 127 that penetrate through the outer peripheral surface and the inner peripheral surface of the insulating film base 121. The plural holes 127 are each formed in a circular shape or a rectangular shape, and are arranged to distribute substantially uniformly in the longitudinal direction and the circumferential direction of the insulating film base 121. Each hole 127 may be any hole as long as the hole penetrates through the insulating film base 121. The size is properly set.

As shown in FIG. 8C, in the charging member 120 according to this second exemplary embodiment, the conducting adhesive 125 is uniformly applied to the outer peripheral portion 121*a* of the insulating film base 121 and hardened, so that a portion 125*c* of the conducting adhesive 125 enters the inside of the plural holes 127, reaches the inner peripheral portion 121*b* of the insulating film base 121, and is exposed. Accordingly, in the insulating film base 121, the outer peripheral portion 121*a* and the portion of the inner peripheral portion 121*b* corresponding to the holes 127 have electrical continuity through the conducting adhesive 125. While the portion 125*c* of the conducting adhesive 125 is at least exposed to the inner peripheral portion 121*b* of the insulating film base 121, the conducting adhesive 125 may be applied so that the portion 125*c* protrudes from the inner peripheral portion 121*b*.

With this second exemplary embodiment, the conducting adhesive 125 does not have to extend to the inner periphery side through the end portion along the longitudinal direction of the insulating film base 121.

Other configurations and operations are similar to those of the first exemplary embodiment and hence the description is omitted.

Third Exemplary Embodiment

Figure 9:
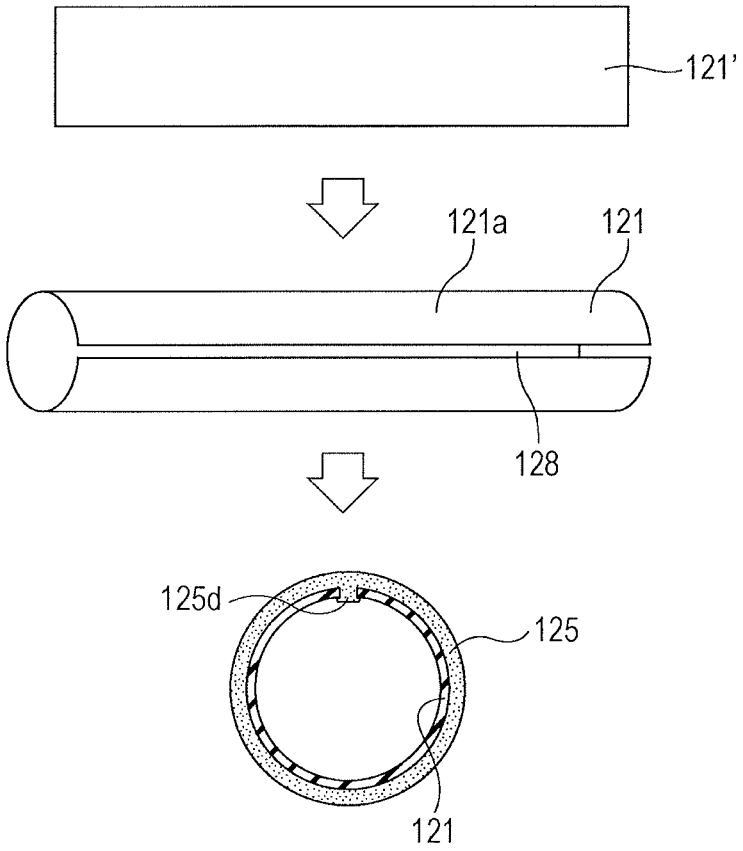
FIG. 9 provides configuration diagrams each showing a manufacturing method of a charging device according to a third exemplary embodiment of the invention.

FIG. 9 is a configuration diagram showing a charging device according to a third exemplary embodiment of the invention.

In this third exemplary embodiment 3, as shown in FIG. 9, an insulating film material 121' formed in a substantially rectangular shape in plan view is provided. By winding the insulating film material 121' around a columnar or cylindrical core member (not shown), a cylindrical insulating film base 121 is formed. At this time, the cylindrical insulating film base 121 is arranged in a state in which both end portions are separated and face each other along the circumferential direction through a thin gap 128. Consequently, the gap 128 is provided in a linear shape along the longitudinal direction of the insulating film base 121. The core member (not shown) is removed later.

Then, as shown in FIG. 9, in the charging member 120 according to this third exemplary embodiment, the conducting adhesive 125 is uniformly applied to an outer peripheral portion 121*a* of the insulating film base 121 and hardened, so that a portion 125*d* of the conducting adhesive 125 enters the inside of the gap 128, reaches an inner peripheral portion 121*b* of the insulating film base 121, and is exposed. Accordingly, in the insulating film base 121, the outer peripheral portion 121*a* and a portion of the inner peripheral portion 121*b* have electrical continuity through the portion 125*d* entering the inside of the gap 128.

In this third exemplary embodiment, since the portion 125*d* of the conducting adhesive 125 is arranged only at the portion along the circumferential direction of the inner peripheral portion 121*b* of the insulating film base 121, to ensure the conduction with the power supply member 124 over the entire periphery of the insulating film base 121 when the insulating film base 121 rotates, a conducting lubricant (not shown) is applied to the inner peripheral surface of the insulating film base 121, hence power supply from the inside is assisted, and the insulating film base 121 is used.

As described above, in the third exemplary embodiment, since the conducting adhesive 125 does not have to extend to the inner periphery side through the end portion along the longitudinal direction of the insulating film base 121, the charging member 120 may be easily manufactured as compared with a case in which the conducting adhesive 125 extends to the inner periphery side through the end portion of the insulating film base 121, similarly to the second exemplary embodiment.

Other configurations and operations are similar to those of the first exemplary embodiment and hence the description is omitted.

Fourth Exemplary Embodiment

Figure 10:
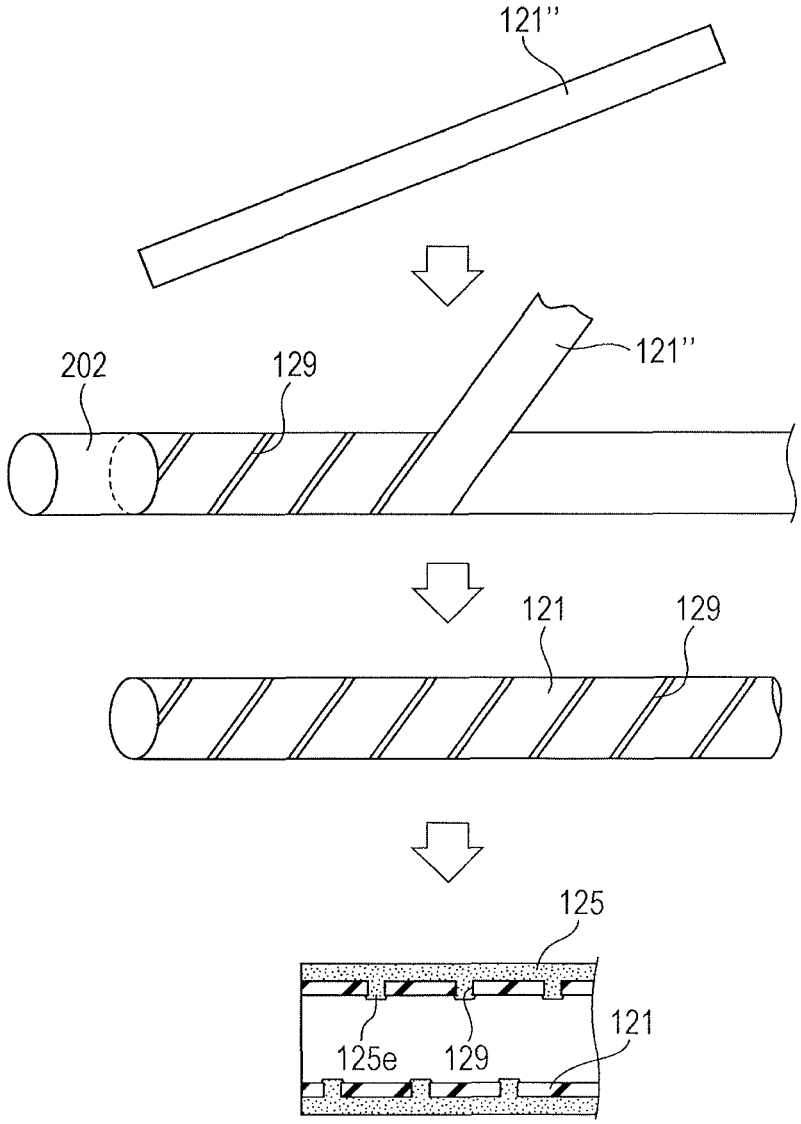
FIG. 10 provides configuration diagrams each showing a manufacturing method of a charging device according to a fourth exemplary embodiment of the invention.
Figure 11:
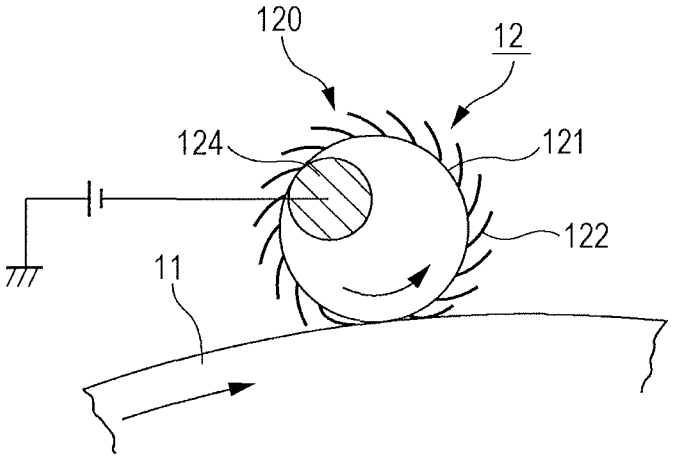
FIG. 11 is a configuration diagram showing a charging device according to an example.

FIG. 10 is a configuration diagram showing a charging device according to the fourth exemplary embodiment of the invention.

In this fourth exemplary embodiment, as shown in FIG. 10, an insulating film material 121" formed in a narrow and long strip shape (tape shape) or a narrow and long substantial strip shape is provided. By winding the insulating film material 121" on the outer periphery of a columnar or cylindrical core member 202 in a spiral or substantially spiral form so that adjacent edges face each other through a gap 129, a cylindrical or substantially cylindrical insulating film base 121 is formed. The core member 202 is removed later.

Then, as shown in FIG. 10, in the charging member 120 according to this fourth exemplary embodiment, the conducting adhesive 125 is uniformly applied to an outer peripheral portion 121*a* of the insulating film base 121 and hardened, so that a portion 125*e* of the conducting adhesive 125 enters the inside of the gap 129, reaches an inner peripheral portion 121*b* of the insulating film base 121, and is exposed. Accordingly, in the insulating film base 121, the outer peripheral portion 121*a* and a portion of the inner peripheral portion 121*b* have electrical continuity through the portion 125*e* of the conducting adhesive 125 entering the inside of the gap 129.

As described above, in this fourth exemplary embodiment, since the conducting adhesive 125 does not have to extend to the inner periphery side through the end portion along the longitudinal direction of the insulating film base 121, the charging member 120 may be easily manufactured as compared with a case in which the conducting adhesive 125 extends to the inner periphery side through the end portion of the insulating film base 121, similarly to the second and third exemplary embodiments.

Other configurations and operations are similar to those of the first exemplary embodiment and hence the description is omitted.

Example 1

Next, to ensure the effect of the image forming device 1 to which the charging device 12 according to any of the exemplary embodiments is applied, the inventor performs an experiment by prototyping a bench model including the image generating device 10 as shown in FIG. 2, holding the charging member 120 of the charging device 12 by the power supply member 124 arranged inside to contact the surface of the photoconductor drum 11, applying the charging voltage to the charging member 120 through the power supply member 124, executing a paper feed test for 50 KPV (50,000 sheets) of A4 size with an area coverage of 5%, periodically printing halftone images, and checking a vertical line (a color line) in halftones due to a charging failure caused by a power supply failure occurring when a toner or a foreign substance such as an additive to the toner adheres to the surface of the power supply member. The charging member 120 of the charging device 12 according to any of the first to fourth exemplary embodiments is used.

The application voltage to the charging member 120 is set at −930 V, which is a relatively low voltage, with regard to a case in which relatively low potential setting may be occasionally selected depending on potential setting of a device.

Comparative Examples 1 and 2

Figure 12A:
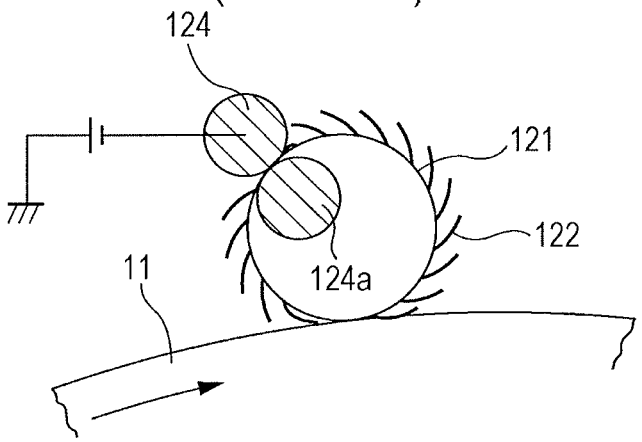
FIG. 12A (Related Art)
FIGS. 12A and 12B are configuration diagrams showing charging devices according to comparative examples.
Figure 12B:
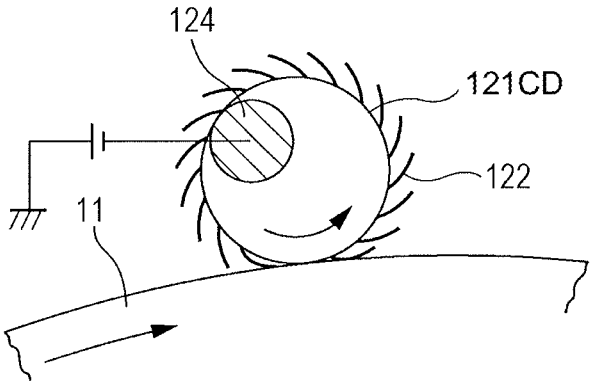
FIG. 12B (Related Art)

Also, as Comparative Examples 1 and 2, as shown in FIGS. 12A and 12B, with use of charging devices 12 configured to cause a power supply member 124 arranged outside a charging member 120 and a power supply member 124 arranged inside a charging member 120 to apply a charging voltage, each of experiments are performed by executing a paper feed test for 50 KPV (50,000 sheets) of A4 size with an area coverage of 5%, periodically printing halftone images, and checking a vertical line (a color line) in halftones due to a charging failure caused by a power supply failure occurring when a toner or a foreign substance such as an additive to the toner adheres to the surface of the power supply member. The application voltage to the charging member 120 is set at −930 V similarly to Example 1.

In Comparative Example 1 shown in FIG. 12A, the charging member 120 formed in an endless shape is supported by a columnar support member 124*a* arranged inside, and the columnar power supply member 124 arranged outside supplies the charging voltage to conducting fibers 122 while the charging member 120 contacts the surface of a photoconductor drum 11. A film base 121 uses an insulating film base.

Also, in Comparative Example 2 shown in FIG. 12B, the charging member 120 formed in an endless shape is supported by the columnar power supply member 124 arranged inside, and the power supply member 124 supplies power to conducting fibers 122 through a conducting film base 121CD while the charging member 120 contacts the surface of a photoconductor drum 11.

FIG. 13 is a table showing the results of Example 1 and Comparative Examples 1 and 2.

As it is found from FIG. 13, in Example 1 using the charging member that provides the conduction between the outer peripheral surface and at least the portion of the inner peripheral surface of the insulating film base 121 through the conducting adhesive, manufacturing requires a low cost because the insulating film base 121 is used. In addition, since the charging voltage is applied from the power supply member 124 arranged in the insulating film base 121 to the conducting fibers 122 through the conducting adhesive 125, a vertical line (a color line) in a halftone due to a power supply failure caused by adhesion of a foreign substance to the power supply member 124 is negligible.

In contrast, in case of Comparative Example 1, as it is found from FIG. 13, although manufacturing requires a low cost because the insulating film base 121 is used, since the charging voltage is applied from the power supply member 124 arranged outside the insulating film base 121 to the conducting fibers 122, a vertical line (a color line) occurs in a halftone due to a charging failure caused by a power supply failure occurring when a toner or a foreign substance such as an additive to the toner adheres to the surface of the power supply member.

In case of Comparative Example 2, since the charging voltage is applied from the power supply member 124 arranged in the conducting film base 121CD to the conducting fibers 122 through the conducting film base 121CD, a vertical line (a color line) in a halftone due to a charging failure caused by a power supply failure occurring when a toner or a foreign substance such as an additive to the toner adheres to the surface of the power supply member is negligible; however, the cost is increased because the conducting film base 121CD is used.

Fifth Exemplary Embodiment

Figure 14:
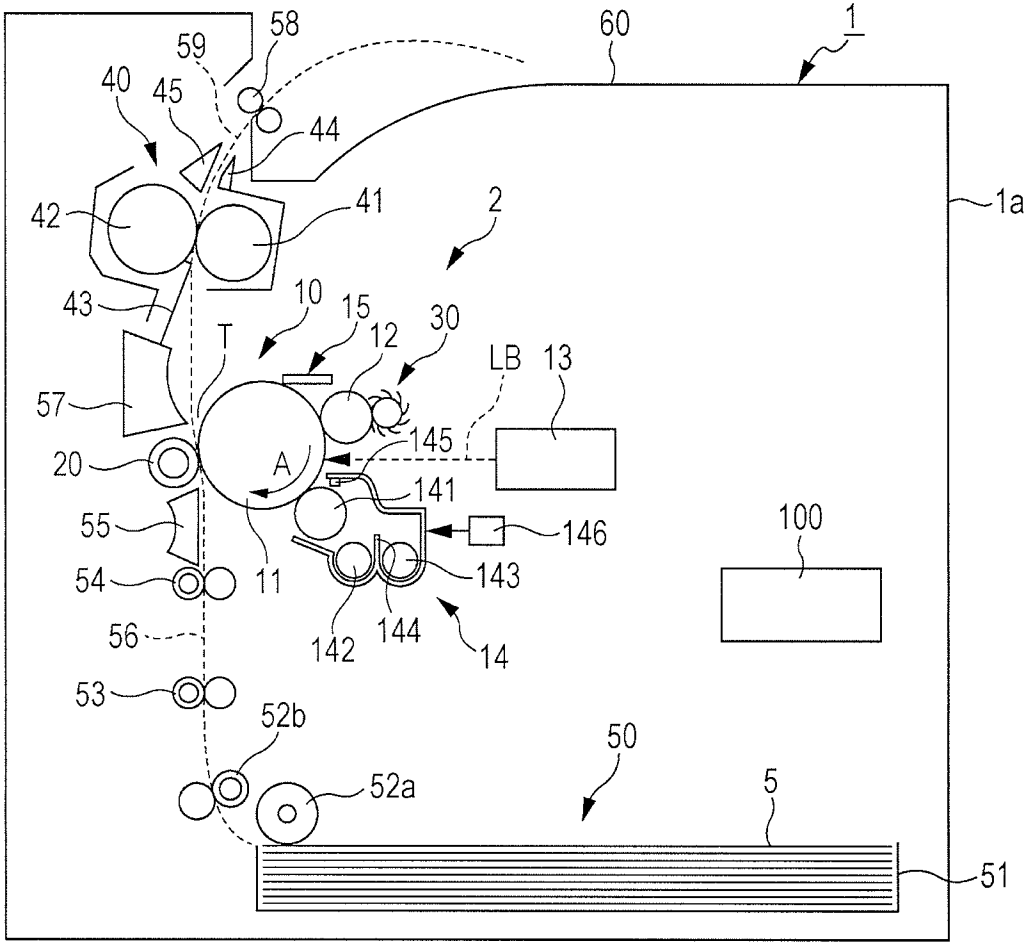
FIG. 14 is a configuration diagram showing an image forming device to which a cleaning device according to a fifth exemplary embodiment of the invention is applied.
Figure 15:
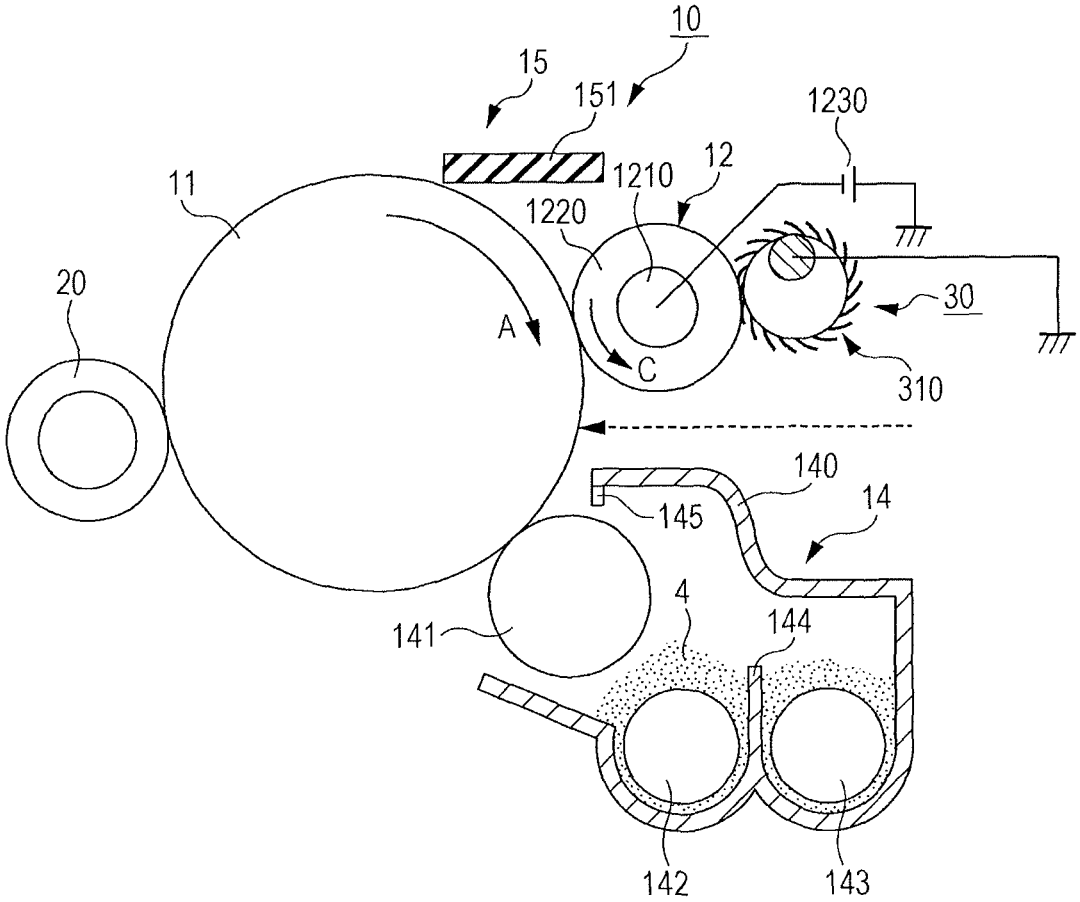
FIG. 15 is a configuration diagram showing an image forming unit of the image forming device according to the fifth exemplary embodiment of the invention.
Figure 16:
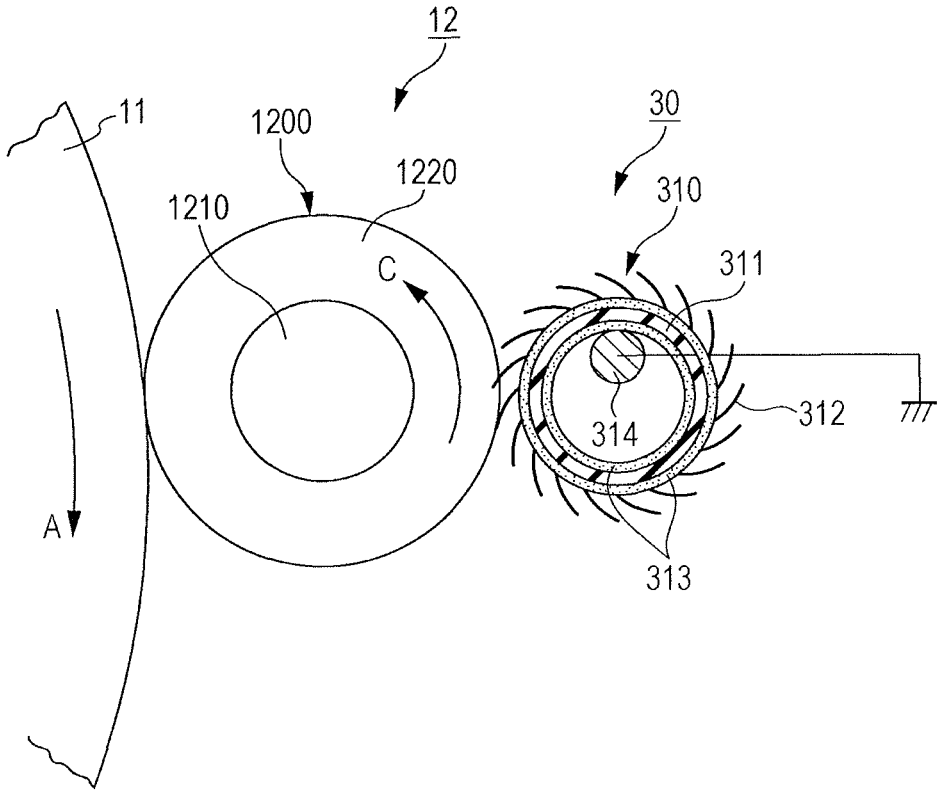
FIG. 16 is an enlarged configuration diagram showing the cleaning device.

FIGS. 14 to 16 are configuration diagrams each showing a cleaning device according to a fifth exemplary embodiment of the invention.

In this fifth exemplary embodiment, as shown in FIGS. 14 to 16, a conducting brush is not used as a charging device of an image forming device, but is used as a cleaning device that cleans up the surface of the charging device.

A charging device 12 is formed of a contact-type charging device including a charging member 1200 arranged in contact with the peripheral surface of the photoconductor drum 11. The charging device 12 is formed in a roller shape, in which a conducting layer 1220 made of a conducting synthetic resin or synthetic rubber is covered on the outer periphery of a core metal 1210 made of metal. To the charging device 12, a charging voltage is applied from a charging high-voltage power supply 1230. If the developing device 14 performs reversal development, a voltage or a current with the same polarity as the charging polarity of the toner supplied from the developing device 14 is supplied as the charging voltage. The charging device 12 with a small size and a small diameter tends to be used to meet reduction in size of the image forming device 1. The charging member 1200 forming the charging device 12 has, for example, an outer diameter of about 12 mm in case of an image forming device 1 for A3 size, or an outer diameter of about 9 mm in case of an image forming device 1 for A4 size. Also, the charging device 12 includes a cleaning device 30 that cleans up the surface of the charging member 1200 as a member to be cleaned.

The cleaning device 30 includes a cylindrical or substantially cylindrical insulating film base 311, conducting fibers 312 densely adhering to the outer peripheral surface of the insulating film base 311 through a conducting adhesive 313, and an energizing member 314 as an example of an energizing unit that is arranged to contact the inner peripheral surface of the insulating film base 311 and applies a cleaning voltage to the conducting fibers 312 or grounds the conducting fibers 312.

The cleaning member 310 as an example of a conducting brush formed of the insulating film base 311 in which the conducting fibers 312 densely adhere through the conducting adhesive 313 is configured similarly to the charging member 120 according to any of the above-described first to fourth exemplary embodiments. The cleaning member 310 is supported by the columnar energizing member 314 arranged to be fixed to the inside, and is connected to the earth (grounded) through the energizing member 314.

Figure 17:
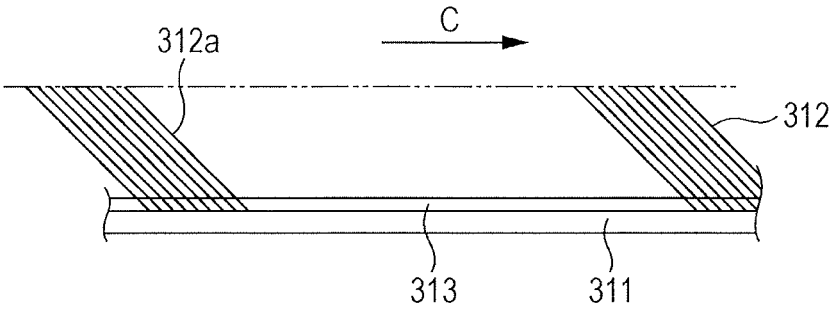
FIG. 17 is an explanatory illustration showing an adhesion state of conducting fibers.

The cleaning member 310 is manufactured similarly to the manufacturing method of the charging member according to any of the above-described first to fourth exemplary embodiments. However, as shown in FIG. 17, to attain a scraping effect by the rigidity of the conducting fibers 312 when tip ends 312*a* of the conducting fibers 312 are separated from the surface of the charging device 12, the conducting fibers 312 are desirably arranged in a state in which the tip ends 312*a* of the conducting fibers 312 are tilted toward the upstream side along a rotation direction C of the charging member 120 or in a state in which the tip ends 312*a* are laid substantially in parallel to the direction along the rotation direction C.

In this fifth exemplary embodiment, as shown in FIG. 16, since the cleaning member 310 contacts the surface of the charging device 12, the conducting fibers 312 of the cleaning member 310 may be grounded through the conducting adhesive 313 and the energizing member 314. In addition, because of an electricity eliminating effect and a scraping effect of the conducting fibers 312, a toner and a foreign substance such as an additive to the toner may be efficiently removed from the surface of the charging device 12 and hence the charging device 12 may be cleaned up.

Also, the cleaning member 310 may use the insulating film base 311 as the film base. As compared with a case in which a conducting film base is used, an increase in cost may be avoided.

Also, in the exemplary embodiment, the case of cleaning up the surface of the charging device, as the cleaning device, has been described; however, the cleaning device may be used to clean up the surface of the photoconductor drum.

Also, in the exemplary embodiment, the case of grounding the cleaning member 310 has been described; however, an energizing unit may apply a voltage with the same polarity as the application voltage of the charging device to the cleaning member 310. For example, if an application voltage difference between the cleaning member 310 and the charging device 12 is large, an electric discharge occurs, and the discharge may cause a problem, a voltage relatively equivalent to the voltage of the charging device 12 may be applied to the cleaning member 310. Also, if an electrically cleaning effect is desired to be increased, for example, the application voltage difference between the cleaning member 310 and the charging device 12 may be increased within a range not causing a discharge.

Example 2

Figure 18:
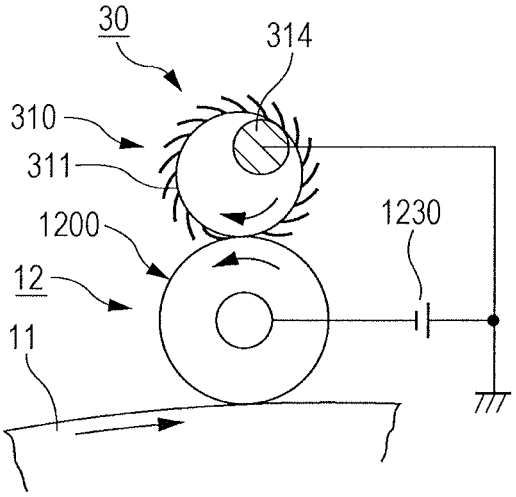
FIG. 18 is a configuration diagram showing a charging device according to an example.

Next, to ensure the effect of the image forming device 1 to which the cleaning device 30 according to the fifth exemplary embodiment is applied, the inventor performs an experiment by prototyping a bench model including the image generating device 10 as shown in FIG. 15, arranging the cleaning member 310 of the cleaning device 30 to contact the surface of the charging member 1200 by the energizing member 314 arranged inside and grounding the cleaning member 310 through the energizing member 314 as shown in FIG. 18, executing a paper feed test for 50 KPV (50,000 sheets) of A4 size with an area coverage of 5%, periodically printing halftone images, and checking a vertical line (a color line) in halftones due to filming of a toner or a foreign substance such as an additive to the toner on the surface of the charging member occurring when a foreign substance adheres to the energizing member and elimination of electricity of the conducting fibers is insufficient. The application voltage to the charging member 1200 is set at −930 V, which is a relatively low voltage, with regard to a case in which relatively low potential setting may be occasionally selected depending on potential setting of a device.

Comparative Examples 3 and 4

Figure 19A:
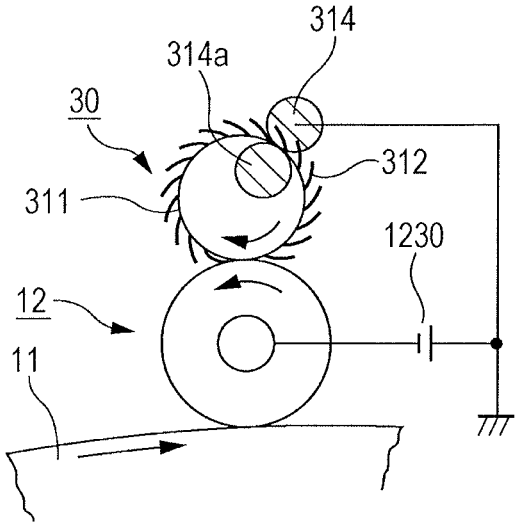
FIG. 19A (Related Art)
FIGS. 19A and 19B are configuration diagrams showing charging devices according to comparative examples.
Figure 19B:
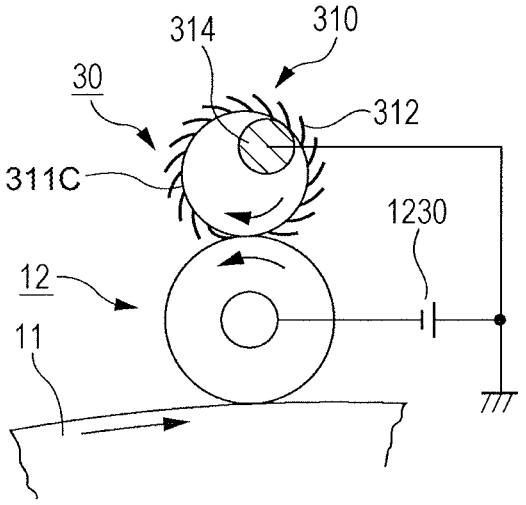
FIG. 19B (Related Art)

Also, as Comparative Examples 3 and 4, as shown in FIGS. 19A and 19B, with use of cleaning devices 30 configured to be grounded through an energizing member 314 arranged outside a cleaning member 310 and an energizing member 314 arranged inside a cleaning member 310, each of experiments are performed by executing a paper feed test for 50 KPV (50,000 sheets) of A4 size with an area coverage of 5%, periodically printing halftone images, and checking a vertical line (a color line) in halftones due to filming of a toner or a foreign substance such as an additive to the toner on the surface of the charging member when a foreign substance adheres to the energizing member and elimination of electricity of the conducting fibers is insufficient. The application voltage to the charging member 1200 is set at −930 V similarly to the example.

In Comparative Example 3 shown in FIG. 19A, the cleaning member 310 formed in an endless shape is supported by a columnar support member 314*a* arranged inside, and the columnar energizing member 314 arranged outside grounds conducting fibers 312 while the cleaning member 310 contacts the surface of a charging member 1200. A film base 311 uses an insulating film base.

Also, in Comparative Example 4 shown in FIG. 19B, the cleaning member 310 formed in an endless shape is supported by the columnar energizing member 314 arranged inside, and the energizing member 314 grounds conducting fibers 312 through a conducting film base 311C while the cleaning member 310 contacts the surface of a charging member 1200.

FIG. 20 is a table showing the results of Example 2 and Comparative Examples 3 and 4.

As it is found from FIG. 20, in Example 2 using the cleaning member 310 that provides the conduction between the outer peripheral surface and at least the portion of the inner peripheral surface of the insulating film base 121 through the conducting adhesive 313, manufacturing requires a low cost because the insulating film base 311 is used. In addition, since the conducting fibers 312 are grounded from the energizing member 314 arranged in the insulating film base 311 through the conducting adhesive 313, occurrence of filming of the charging member 1200 due to an electricity elimination failure caused by adhesion of a foreign substance to the energizing member 314 is negligible.

In contrast, in case of Comparative Example 3, as it is found from FIG. 20, although manufacturing requires a low cost because the insulating film base 311 is used, since the conducting fibers 312 are grounded through the energizing member 314 arranged outside the insulating film base 311, filming of the charging member 1200 occurs due to an electricity elimination failure caused by adhesion of a foreign substance to the conducting fibers 312 and the energizing member 314.

In case of Comparative Example 4, since the conducting fibers 312 are grounded by the energizing member 314 arranged in the conducting film base 311C through the conducting film base 311C, occurrence of filming of the charging member 1200 due to an electricity elimination failure caused by adhesion of a foreign substance to the energizing member 314 is negligible; however, the cost is increased because the conducting film base 311C is used.

In any of the above-described exemplary embodiments, the image forming device that forms a monochrome image has been described as an image forming device. However, it is not limited thereto. Of course, any of the above-described exemplary embodiments may be applied to an image forming device that forms a color image made of, for example, yellow (Y), magenta (M), cyan (C), and black (K).

Also, in the third exemplary embodiment, the conducting lubricant (not shown) is applied to the inner peripheral surface of the insulating film base 121, hence power supply from the inside is assisted, and the insulating film base 121 is used. However, the conducting lubricant (not shown) may be applied to the inner peripheral surface of the insulating film base 121 in any of the other exemplary embodiments 1, 2, and 4.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conducting brush comprising:

a substantially cylindrical insulating film base; and a conducting fiber adhering to an outer peripheral surface of the insulating film base through a conducting adhesive or a conducting adhesive medium, wherein an outer peripheral portion where the conducting fiber adheres and at least a portion of an inner peripheral portion of the insulating film base have electrical continuity through the conducting adhesive or the conducting adhesive medium.

2. The conducting brush according to claim 1, wherein the outer peripheral portion and at least the portion of the inner peripheral portion have electrical continuity through the conducting adhesive by applying the conducting adhesive on an end portion of the outer peripheral surface in a longitudinal direction to connect the outer peripheral portion and at least the portion of the inner peripheral portion with the conducting adhesive.

3. The conducting brush according to claim 1, wherein the insulating film base has a plurality of holes penetrating through the insulating film base, and the outer peripheral portion and at least the portion of the inner peripheral portion of the insulating film base have electrical continuity through the conducting adhesive by applying the conducting adhesive to reach the inner peripheral portion through the holes.

4. The conducting brush according to claim 1, wherein the insulating film base has a gap extending in a longitudinal direction of the insulating film base, and the outer peripheral portion and at least the portion of the inner peripheral portion have electrical continuity through the conducting adhesive by applying the conducting adhesive to reach the inner peripheral portion through the gap of the insulating film base.

5. The conducting brush according to claim 4, wherein the insulating film base is formed into a cylindrical shape by winding an insulating film material in a substantially spiral form so that adjacent edges of the insulating film material face each other through the gap.

6. An image forming device comprising:

the conducting brush according to claim 1; and a voltage applying unit that is arranged to contact the inner peripheral portion, and applies a charging voltage to the conducting fiber.

7. An image forming device comprising:

the conducting brush according to claim 1; and an energizing unit that is arranged to contact the inner peripheral portion, and applies a cleaning voltage to the conducting fiber or grounds the conducting fiber.

* * * * *